US007582190B2

(12) United States Patent
Salm

(10) Patent No.: US 7,582,190 B2
(45) Date of Patent: Sep. 1, 2009

(54) SHAPED PULP ARTICLE AND RESULTING SURFACE COVERING AND METHOD OF MAKING SAME

(75) Inventor: Jaime Salm, Philadelphia, PA (US)

(73) Assignee: Mio Company, LLC, Philadelphia, PA (US)

( * ) Notice: Subject to any disclaimer, the term of this patent is extended or adjusted under 35 U.S.C. 154(b) by 0 days.

(21) Appl. No.: 11/202,450

(22) Filed: Aug. 12, 2005

(65) Prior Publication Data

US 2007/0034346 A1 Feb. 15, 2007

(51) Int. Cl.
*D21F 13/00* (2006.01)

(52) U.S. Cl. ..... 162/218; 162/224; 162/226; 162/227; 162/396

(58) Field of Classification Search ..... 162/218, 162/224, 226, 227, 396; 264/322, 324
See application file for complete search history.

(56) References Cited

U.S. PATENT DOCUMENTS 2,377,864 A * 6/1945 Chaplin ..... 162/219
7,067,041 B2 * 6/2006 Tsuura et al. ..... 162/218

* cited by examiner

*Primary Examiner*—Mark Halpern
(74) *Attorney, Agent, or Firm*—Reed Smith LLP

(57) ABSTRACT

A shaped pulp article and the method for making same are disclosed. The method of making a shaped pulp article includes the steps of preparing a slurry by mixing at least one material of construction with water, placing the slurry in a porous mold having a shaped molding surface, extracting excess water through the porous mold to form the shaped article, and pressing the shaped article between complementary heated male and female structures.

20 Claims, 2 Drawing Sheets

FIGURE 1
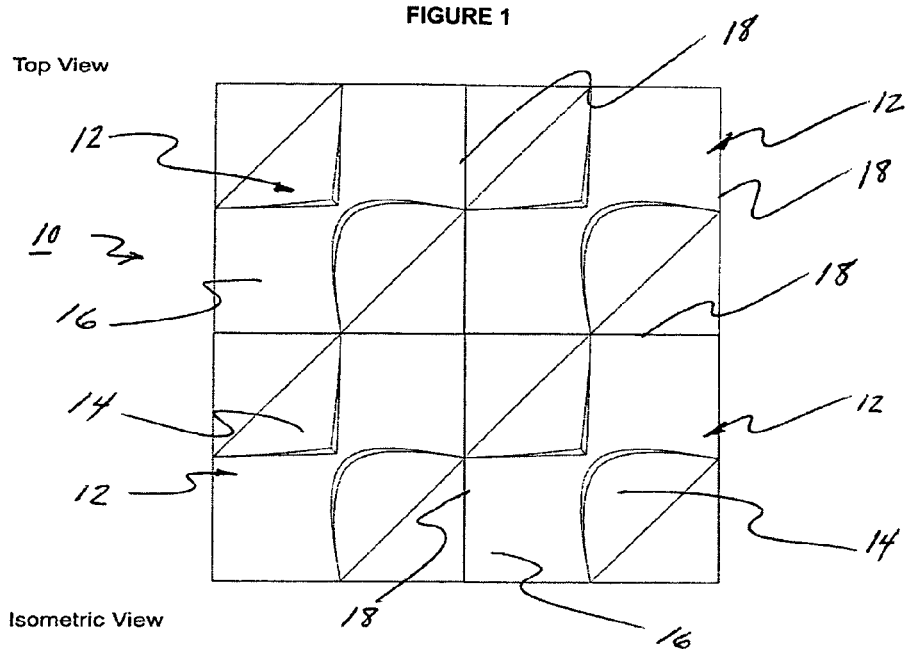
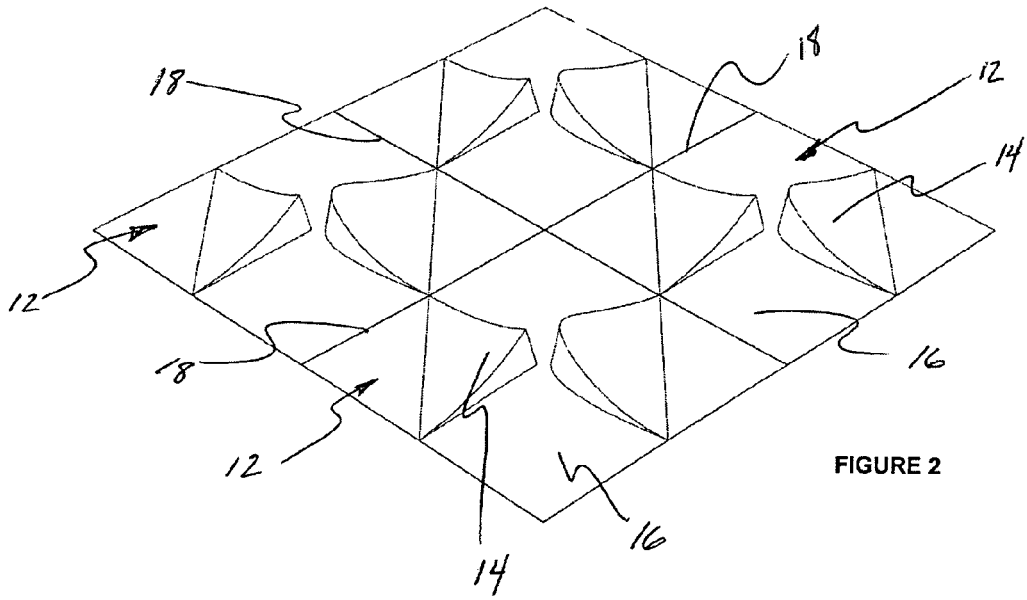
FIGURE 2

Top View 3 different 4 Tile Sample Patterns
FIGURE 3
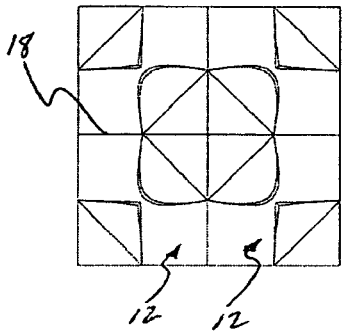
FIGURE 4
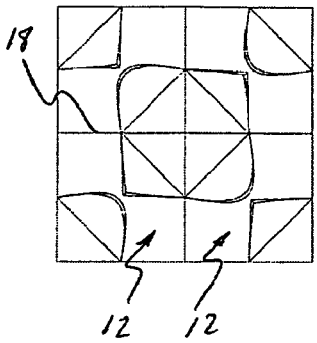
FIGURE 5
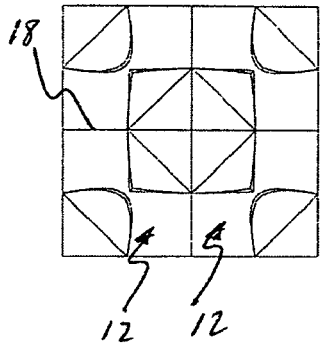
Top View 16 Tile Sample Pattern
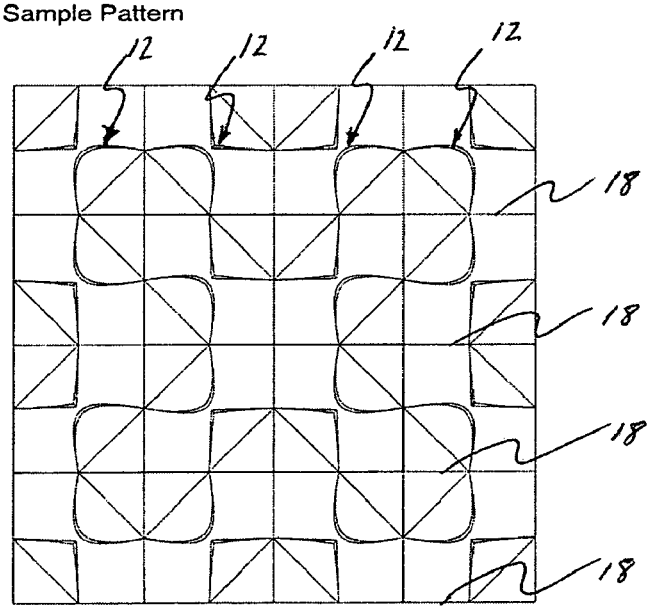
FIGURE 6

SHAPED PULP ARTICLE AND RESULTING SURFACE COVERING AND METHOD OF MAKING SAME

STATEMENT REGARDING FEDERALLY SPONSORED RESEARCH OR DEVELOPMENT

Not Applicable.

BACKGROUND OF THE INVENTION

1. Field of the Invention

The present invention is directed generally to a method and apparatus for creating a surface covering and, more particularly, to a three-dimensional shaped article.

2. Description of the Background

It has long been appreciated that natural resources are limited and continue to be depleted with each passing day. An awareness has also arisen over the detrimental impact certain materials and products have on the environment. The USEPA estimates that commercial and residential rubbish in the United States amounts to more than 200 million tons a year. Much of this material, such as paper and paperboard, is biodegradable and can be recycled, keeping it out of landfills thereby conserving landfill space and extending the lives of landfills. As a result, there is an ongoing need to find uses for biodegradable and recyclable waste materials that can cost effectively replace, outperform, and compete with non renewable and/or non recyclable materials currently in the market The United States Environmental Protection Agency (USEPA) estimates that approximately 36% by weight of all municipal solid waste in the United States is paper and paperboard. Most paper and paperboard is recyclable and the use of recycled paper and paperboard is not new. Recovered paper is used to make a variety of products including copier paper and corrugated boxes, for example. The USEPA estimates that in 2001 the percentage of paper and paperboard recovered for recycling was approximately 45%.

The use of recycled molded paper or fibrous materials as an alternative material for use in consumer products is not new. For example, molded fiber egg and fruit crates, made from recycled paper, have been used for years in the packaging industry. Molded, fibrous, bio-degradable products are also used to produce molded fiber planters and gardening products.

The use of recycled molded paper or fibrous material, although effective as an environmentally friendly alternative material, has been limited to use for a relatively narrow range of products. Also, once a product is made from a molded fibrous material it is generally limited to a specific use. For example, molded fiber crates, while effective as packaging materials, are limited in their use, as are egg and fruit crates. Moreover, molded fiber crates are also not recommended or considered acceptable for use as surface coverings (e.g., wall coverings) for residential or commercial applications since they are not designed for installation on flat surfaces utilizing, for example, water-based or tape adhesives, and do not pass regulatory requirements for furnishings.

Typically, sound panels and acoustical insulators are sold as tiles specifically for improving or dampening acoustic properties of a space. Such tiles are usually made from polymer foam or wooden materials and are readily available to, for example, the construction trade and contractors, as well as directly to consumers such as musicians. However, acoustical tiles tend to be expensive and are installed more often for acoustic needs or desires than for aesthetics or decoration.

Also, the more common uses of acoustic tiles are on walls and ceilings in, for example, music rooms and theaters for dampening or deadening noise. Such tiles are typically mechanically attached to walls and ceilings by a variety of means.

There are also textile products available for dampening sound, which provide a unique appearance to a space. However, many of these products are incapable of being applied to a surface in a manner similar to applying wallpaper or other type of surface treatment. Instead, such products are typically hung, stretched and/or fastened to walls or ceilings in order to create, an aesthetic effect and to improve, acoustic performance. Other textile coverings are designed to be used similar to traditional wallpaper. However, these materials tend to be acoustically limited as well as structurally limited to specific shapes and designs, and to specific textures and weaves and generally require expensive and often tedious on-site installation.

Other known products include molded panels, specifically designed to enhance acoustic properties of an interior space. These products are typically made from molded polyester fibers, and form a self-supporting structural wall panel instead of a surface covering.

Thus, there is a need to develop an environmentally friendly surface covering product that is biodegradable and recyclable, yet functional and aesthetic, and that can be inexpensively manufactured using existing machinery and readily available recycling infrastructures.

BRIEF SUMMARY OF THE INVENTION

The present invention is directed to shaped or contoured articles or tiles that form a surface covering when arranged one next to the other. The articles may be made from one of molded pulp, paper and fibrous materials or any combination of thereof. Made of environmentally friendly and recyclable materials, these coverings may be provided in various shapes, sizes and thicknesses. The "shaped pulp articles," as they will be referred to throughout the description, are functional, aesthetic, cost effective and may provide an alternative to making less environmentally friendly acoustic and decorative surface covering materials and products. Furthermore, the shaped pulp articles may be formatted and/or arranged in many ways by reconfiguring the shaped pulp articles through rotation to create different patterns. The resulting surface covering, which may comprise more than one shaped pulp article, may have acoustic and decorative properties, and patterns which can be painted, colored, coated, written on, drawn on, cut and rearranged, and finished in various ways, including use as base forms to be plastered or finished. The shaped pulp articles may also be used to make cast forms from various materials including but not limited to cements, epoxies, plasters and other building and construction materials.

According to one aspect of the present invention, a method for the manufacture of the shaped pulp article includes the steps of: preparing a slurry by mixing the pulp, paper or fiber with water and any additional additives, such as, for example, fire retardant chemicals, hardeners, water repellent, dirt repellent coatings, anti-microbial, waxes, and/or resins, dyestuffs or solids to achieve a particular look to the end product or physical, chemical or other properties as required by the specific market or client of the final product; providing a molding part comprising a porous molding layer having a shaped molding surface; molding an article on the molding surface of the molding part by suction through the part; and removing the article from the part.

Furthermore, the present invention includes a method for forming a shaped pulp article includes the steps of: preparing a slurry by mixing the at least one of pulp, paper and fiber with water; placing the slurry in a porous mold having a shaped molding surface; extracting excess water through the porous mold to form the shaped article; dipping the shaped article in a second slurry prepared from at least one of pulp, paper and fiber mixed with water; and pressing the shaped article between complementary heated male and female structures to provide a shaped pulp article having a substantially smooth surface.

The present invention solves problems experienced with the prior art because it provides an environmentally friendly surface covering product that is biodegradable and recyclable, yet functional and aesthetic, and that can be inexpensively manufactured using existing machinery and readily available recycling infrastructures. Those and other advantages and benefits of the present invention will become apparent from the detailed description of the invention herein below.

BRIEF DESCRIPTION OF THE SEVERAL VIEWS OF THE DRAWING

Understanding of the present invention will be facilitated by consideration of the following detailed description of the preferred embodiments of the present invention taken in conjunction with the accompanying drawings, in which like numerals refer to like parts, and wherein:

FIG. 1 is a top plan view of surface covering formed of a plurality of juxtaposed articles arranged to exhibit a predetermined pattern, according to a preferred embodiment of the invention;

FIG. 2 is an isometric view of the surface covering shown in FIG. 1;

FIG. 3 is a top plan view of another embodiment of the surface covering according to the invention;

FIG. 4 is a top plan view of another embodiment of the surface covering according to the invention;

FIG. 5 is a top plan view of another embodiment of the surface covering according to the invention; and FIG. 6 is a top plan view of another embodiment of the surface covering according to the invention.

DETAILED DESCRIPTION OF THE INVENTION

It is to be understood that the figures and descriptions of the present invention have been simplified to illustrate elements that are relevant for a clear understanding of the present invention, while eliminating, for purposes of clarity, many other elements found in typical surface covering applications and materials. Those of ordinary skill in the art will recognize that other elements are desirable and/or required in order to implement the present invention. However, because such elements are well known in the art, and because they do not facilitate a better understanding of the present invention, a discussion of such elements is not provided herein.

The invention may include a shaped or contoured article and the resulting surface covering produced by installing the articles side by side made from a molded pulp, paper or fibrous material which is environmentally friendly and recyclable and which can be provided in various shapes, sizes and thicknesses. The shaped pulp articles of the present invention may be used on, or as, a wide variety of surfaces, including, for example, walls and ceilings. The shaped pulp articles may also be used in a wide variety of environments. The articles may be used on any surface to which they can be applied using conventional application methods as described below and/or as known to those skilled in the art. By way of non-limiting example only, the articles may be used in living spaces, for example, houses, offices, schools, universities, hotels, lobbies, conference rooms, libraries, theaters and hallways. The articles may also be used as surfaces, including, for example, walls, ceilings, displays and exhibits for museums, retail, restaurants, nightclubs, lofts, coliseums, and waiting rooms, for example. Preferably, the articles may be installed on existing walls or ceilings in a dry environment or an environment protected from the elements, including rain, snow and humidity.

The articles may be maintained, replaced and recycled in a convenient manner. By way of non-limiting example only, if a shaped pulp tile of the present invention is damaged or stained in a permanent way, the tile may be removed from the wall or ceiling where it is applied or installed, and replaced with a new tile. Further, an article may be installed on a wall by, for example; by using a metal or plastic putty knife to remove the old or damaged article from the wall; cleaning the exposed wall to remove any remaining adhesive used to apply the old or damaged article to the wall; and installing a new article on the wall using new adhesive or by simply removing damaged articles from a drop-ceiling frame or similar mounting structure. The replaced article may be simply disposed of or recycled.

The shaped pulp articles of the present invention may have applied to them a topical coating of additives, such as preservatives, repellants, retardants, colorants, hardeners, anti-microbial substances, waxes, and/or resins for example. The shaped pulp articles of the present invention may, by way of non-limiting example only, be sprayed with a water repellant and/or stain repellant product in order to repel the infiltration of moisture and/or staining of the shaped pulp articles and/or sprayed with fire retardant additives to have products that pass fire code-and safety standards for construction materials. The shaped pulp articles may also have such additives incorporated during the manufacturing process. The shaped pulp articles of the present invention may also be installed on many different surfaces using a variety of different installation materials and techniques. Preferably, the shaped pulp articles are installed on flat surfaces or surfaces with slight curvature using an adhesive material. The shaped pulp articles may be suitable for any configuration as they may be manufactured or manipulated into various shapes and sizes. Adhesives such as, for example, wallpaper adhesives, Velcro, thumb tacks, double stick tapes, nails, screws, and staples may be suitable for installation. The shaped pulp articles may be applied more permanently or temporarily depending on the application and the adhesive selection.

The shaped pulp articles of the invention may, because of their contoured shape, form various decorative patterns through rotation of the article and addition of articles to form larger patterns. These patterns may be determined prior to installation of the articles, so that an installation can be completed more quickly and efficiently. Preferably, when installing the articles as a covering, the articles may be installed one by one to minimize gaps between the articles.

The shaped pulp articles of this invention are effective for a variety of commercial applications. The shaped pulp articles can be produced to meet the requirements of the ASTM 84 Class A Fire Test, as well as other ASTM and other various material standards.

Referring now to the drawings, FIGS. 1 and 2 shows a preferred embodiment of the invention which is a surface covering, generally designated as 10, including articles 12, having elevations 14 and depressions 16. The articles 12 are shown fitted together at edges 18 such that no gaps appear between the articles 12. As configured, the articles 12 form a four-sided elevated pattern, created by fitting four articles 12 together having elevations 14 and depressions 16. It will be appreciated, however, that the same articles may be rotated to form alternative patterns. For example, FIGS. 3-5, show three alternative patterns are formed by rotating the same four articles 12, shown in FIGS. 1 and 2. More complex patterns are also achievable by increasing the number of articles 12. FIG. 6, for example, shows a pattern formed by arranging sixteen articles 12 in a predetermined fashion.

The surface coverings 10 and articles 12 of the invention are not intended to be limited to the size, shape or patterns shown in FIGS. 1-6. It is understood from the disclosure of this invention that the coverings can be of various shapes and contours to achieve any desired pattern or to conform to any mounting surface or mounting structure. Also, the articles may be comprised of 100% post or pre-consumer waste paper or waste materials. Further, by way of non-limiting example only, the surface covering is, preferably, durable, easily coated or painted, and easily installed and de-installed.

By way of further example, the dimensions at least two assembled and/or installed shaped pulp articles, and therefore the size of the articles, can vary depending on the desired aesthetic pattern to be created or the other constraints or specifications on use. Thus, preferably, the maximum dimensions of the articles of the present invention are such that the articles can be easily handled during packaging, transportation and installation. By way of non-limiting example only, an article may be 12 inches×12 inches (one square foot) for convenience of users in measuring the required quantity of articles needed to cover a particular surface. The shaped pulp articles may be of any dimension and may further be created in its place of installation to avoid the logistics of handling a very large article. By way of non-limiting example only, a shaped pulp article, in the form of a surface covering, for example, may be created in proximity to the final point of installation or in the final point of installation.

The shaped pulp article may also be made of various thicknesses. The thickness of the article will often depend on the desired purpose or function of the application. Preferably, the thickness of the article is approximately 1.3 to 1.5 mm to obtain structural integrity such that it is not easily bent, deformed or warped during manufacturing, transportation, installation and/or use; and at the same time is light enough (approximately 50-60 grams) so that it may be easily installed. The shaped pulp articles may be created with a thickness of about 0.5 mm to about the maximum thickness currently possible by using full-molding or thermoformed molding equipment. Additives that may increase tensile strength may be used with shaped pulp articles with a limited thickness.

The shaped pulp articles may take any shape or form and may incorporate texture, color and any other known visual and/or textual properties. By way of non-limiting example only, the shaped pulp articles may be used as a wall covering and include textual properties that may allow a person who is without sight to navigate a corridor, for example. The shaped pulp articles may incorporate, for example, brail. By further way of non-limiting example, the shaped pulp articles may provide a sighted person with an aesthetic representation of art, or information on how to escape to a fire exit, for example. Preferably, the shape of the article should be such that the use of the shaped pulp articles as a surface covering, for example, does not become an obstruction in, for example, an aisle way, and does not become hazardous to persons or objects as a result of, for example, having pointed elevations or protrusions.

Where the shaped pulp articles of the present invention are being installed on a surface, as opposed to forming a surface themselves, the shaped pulp articles may contact the installation surface at at least one point on the installation surface. The amount of surface area of the shaped pulp article required for contacting the installation surface may depend on several factors including, for example, the surface or structure for installation, the amount and type of adhesive used to apply the articles to the surface and the desired permanency of the installation, for example. By way of non-limiting example only, where the shaped pulp articles are to be permanently installed as a covering, it may be desirable to have a large percentage, and possibly nearly all, of the articles in contact with the installation surface. Preferably, the amount of surface area of a shaped pulp article in contact with an installation surface ranges between about 20 to about 70%. The amount of surface area of an article in contact with an installation surface may also be from about 0 to about 100%. Also, preferably, the points at which an article contacts a surface may be distributed such that the article may not easily separate from the surface or change position, or shift, during the useful life of a covering, for example. By way of non-limiting example only, most or all of the outer edges of an article may contact the installation surface so that the edges of the article do not easily separate or peel away from the installation surface.

In an embodiment of the present invention, a surface covering may comprise articles designed such that when the articles are combined or fitted together, the surface covering as a whole provides a continuous and recognizable pattern defined by the articles' elevations and depressions. The continuous pattern can be the result of either a repetitive or random pattern of the articles. By way of non-limiting example only, the shaped pulp articles may be installed and used as drop-ceiling tiles to get a three-dimensional effect and acoustic benefits, for example.

The edges of the articles that comprise a surface covering, for example, may also form a repetitive or random pattern or both. The resulting patterns may be formed as a result of continuous or discontinuous lines, which are the seams created when two or more articles are combined or fitted together in a contiguous manner, creating, for example, a surface covering.

The edges of the articles, which may create seams in a surface covering installation, may be at least partially concealed. This feature of the invention may be similar to aligning the decorative pattern of, for example, wall paper from an edge of one sheet of wall paper to the edge of the next sheet. Similarly, edges of the articles may be partially concealed by creating a complex or elaborate decorative shaped pattern. By providing such patterns, the focus of the surface covering may be on the pattern formed by the articles' elevations and depressions and not on the articles' contiguously formed edges. Thus, a surface covering, for example, once formed by connecting various edges of at least two articles, may appear to be a continuous covering without seams as a result of the design of its topography.

Preferably, an article's shape and design may be such that other articles, with the same design or of compatible design, may be applied next to each other in order to create a surface covering with an obvious and continuous shape and design.

The shaped pulp articles of the present invention may be made into many different geometric shapes and/or any tessellated configuration, including, but not limited to, squares, rectangles, pentagons and higher order polygons.

The materials of construction, at least some of which comprise the shaped pulp article of the present invention, are those capable of being used in the manufacturing of molded fiber articles. Examples of such materials include, but are not limited to: pulp, paper, newsprint, cardboard, cup stock with and without wax, natural and synthetic fibers, bark, leaves and natural fibers, grass, wheat, water and chemicals, including solvents, to prevent water decomposition, and/or dyes, for example. Preferably, the shaped pulp articles may include pre-and/or post-consumer waste pulp and/or paper, and natural dyes (when the coverings are dyed) or materials which can be re-processed in the manufacturing process, or those that are biodegradable and/or compostable. The shaped pulp article may include about 10 to about 50 percent of the materials of construction and preferably from about 80 percent of such material. By way of non-limiting example only, a shaped pulp article may include from about 20 percent pulp and from about 80 percent water.

The method of making a shaped pulp article includes various molding machines that may be employed in the manufacturing process of the present invention, including machinery used in soft molding, hard molding and full molding processes which may include thermoformed pulp. It will be appreciated by those skilled in the art that changes can be made to the method of the invention, without departing from the broad inventive concept thereof depending on several factors including, but not limited to, the specification and/or quality requirements of, for example, consumers, contractors, and/or installers. For example, where a shaped pulp article is being produced for commercial use, rather than for residential use, a method which employs some of the steps associated with a full-molding process should be employed since such steps generally yields shaped pulp articles which are smoother and more consistent in appearance compared to, for example, shaped pulp articles manufactured by a soft molding process or a non-after-pressed hard molded process, as described in more detail below or optimally the process of thermoformed pulp should be utilized for making an article.

In one illustrative embodiment, a method is provided for molding a shaped pulp article from, for example, fiber pulp, comprising the steps of: (1) preparing a thin slurry by mechanically mixing pulp (paper), water and, if necessary or desired, additives in a blending or mixing device; (2) pumping the slurry into a tank that agitates the slurry in order to keep the fibers from settling; (3) transferring the slurry to a second tank where the slurry is diluted with water; (4) providing a pulp molding die, tool or screen comprising a porous molding layer having a molding surface shaped to the configuration of a tile to be molded; (5) lowering the die into the second tank and in contact with the slurry; (6) molding a pulp article on the molding surface of the die by suction through the die such that water passes through the porous die and the pulp collects on the molding surface until a desired pulp thickness is obtained; and (7) removing the molded pulp article from the die.

In a further illustrative embodiment, an additional "double dipping" step may be performed. In this step, the shaped pulp article is dipped a second time in a tank with slurry prepared with different color dyed pulp, chemicals or pulp material such as cardboard or newsprint. The shaped pulp article is then removed from the die as in step 7. The "double dip" process described above may be performed in various ways for aesthetic and functional results. The first dip or the second dip may be partial, creating, for example, a tie-dye effect, in the part. The dips may be full dips creating, for example, an outer layer and an inner layer of pulp.

Although not a required step in the method, wall thickness and weight measurements of the newly formed shaped pulp article may be taken for quality control purposes, and the article heat dried by, for example, an oven or other heating means.

In a further illustrative embodiment, a "take-off or transfer mold" step may be included to produce a more compact article. The "take-off" or transfer mold step is typically performed after the removing step and may require an additional die for further molding the back side and the front of the article in order to provide a smoother, more consistent surface.

The method of making a shaped pulp article from fiber pulp can also involve the additional step of placing the formed article between two (male and female) dies in, for example, a press that uses temperature and pressure to make parts, in order to make both sides of the article more consistent in texture. This step generally provides an article which, in addition to being very smooth for example, tends to be more consistent in overall shape. Further, the shaped pulp article may be die-cut with a die tool set to provide improved edges and about 90 degree angles on every corner of the articles. The dies, tools or screens described herein may be made from various materials, including, but not limited to, metals, fiberglass and/or ceramics.

The method of making a shaped pulp article from fiber pulp may also involve steps from a full-molding or "thermoformed pulp" process which may provide a more consistent and smooth shaped pulp article. For this process, the same steps are followed with the addition of the transfer mold except that these transfer molds may be heated, stamping the part with heat and pressure to get a generally wrinkle free article. Here, as mentioned in step (1) above, additives such as dyes and/or fibers may be added to the slurry mixture during or after the preparation of the mixture.

As mentioned hereinabove, additives may be added to the method of making a shaped pulp article including, but are not limited to, dyes and retardants. These additives, and possibly others, can be added during the various steps of the method as identified above even when parts are completely formed and dry. Such additives may be sprayed on the articles as a secondary process. Also, preferably, where dyes are used to provide an article of a desired color, the dyes should be dyes that are resistant to ultraviolet rays so as to prevent or minimize discoloration.

The coverings of the present invention may be colored by several different methods including, but not limited to: (1) providing a dye to the slurry described above to produce articles or tiles of virtually any color; (2) adding colored fibers and/or other colored particles to the slurry to create, for example, a colored and/or textured article; and (3) coating the articles by, for example, rolling or spraying the articles with water based or synthetic paints or coatings, after the articles are manufactured, and either before or after they are installed as surface coverings preferably after they are installed.

To create a surface covering from at least one shaped pulp article for installation on a surface, additional steps may be performed. These steps may include: preparing the surface, a wall or ceiling, for example, for installation of the at least one article in accordance with an application technique, instructions and/or requirements; applying the articles to the surface; and, if desired or required, finishing the surface covering by, for example, painting, covering or coating the installed at least one article. Application techniques may include, but are not limited to, pasting, use of an adhesive, nailing, screwing, Velcro, and/or taping.

The method of making the shaped pulp article of the present invention provides a novel use of existing machinery, technology and materials for a new application outside, for example, the traditional use of pulp products in the packaging market. Further, the method of making the present invention may provide an article which may be three-dimensional, acoustic, structural, durable, aesthetic, recyclable, and fire resistant, as well as capable of being colored, coated, covered and designed to specification or code requirements, installed easily with standard wallpaper adhesives or other readily available permanent and temporary adhesives and mounting structures, as well as being able to be cut to fit outlets, switches, sprinklers and other functional or aesthetic protrusions on walls or ceilings (with hand tools or power tools in installation sites). Thus, the shaped pulp article of the present invention may provide several advantages and solve many of the above-discussed problems associated with more traditional shaped pulp articles in a very cost effective manner.

The disclosure herein is directed to the variations and modifications of the elements and methods of the invention disclosed that will be apparent to those skilled in the art in light of the disclosure herein. Thus, it is intended that the present invention covers the modifications and variations of this invention, provided those modifications and variations come within the scope of the appended claims and the equivalents thereof.

What is claimed is:

1. A method of making a three-dimensional shaped pulp wall covering article comprising the steps of:

preparing a slurry by mixing at least one material of construction with water;

placing the slurry in a porous mold having a shaped molding surface;

extracting excess water through the porous mold to form the shaped article;

pressing the shaped article between complementary heated male and female structures, wherein one of said heated male and female structures forms a substantially planar rear surface on said wall covering article, and wherein the other of said heated male and female structures forms a front surface having a varying thickness with respect to said rear surface; and applying an adhesive to said substantially planar rear surface.

2. The method of claim 1 further including the step of dipping the shaped pulp article in at least one second slurry prepared from at least one of pulp, paper and fiber mixed with water.

3. The method of claim 1 further including the step of spraying the shaped pulp article with an additive.

4. The method of claim 1, wherein said heated male and female structures form said shaped pulp wall covering article into a standardized shape, wherein said standardized shape allows said wall covering articles to be used as adjoining tiles to cover a wall.

5. The method of claim 4, wherein said standardized shape forms a rectangular shape.

6. The method of claim 1, wherein said varying thickness forms a pattern on said front surface of said wall covering article.

7. The method of claim 1, wherein said wall covering article has a height, a width, and a height axis parallel to the height of said wall covering article, wherein said varying thickness forms a substantially symmetrical pattern with respect to said height axis.

8. The method of claim 7, wherein said wall covering article has a width axis parallel to the width of said wall covering article, wherein said varying thickness forms a substantially symmetrical pattern with respect to said width axis.

9. The method of claim 1, wherein said wall covering article is sufficiently light in weight such that, where said adhesive is standard wallpaper paste, said wall covering article can be adhered to a standard wall surface.

10. The method of claim 1, wherein said wall covering article is formed to allow said wall covering article to closely abut adjacent wall covering articles.

11. A wall surface covering comprising:

a plurality of juxtaposed shaped pulp articles, said articles each having a height, a width, a varying thickness, a front surface, and a substantially planar rear surface, said height and width being substantially common to all articles;

wherein the shaped pulp articles include at least one material of construction and water; and wherein said rear surface comprises an adhesive such that said shaped pulp articles are adherable to a wall to form a wall covering.

12. The surface covering of claim 11 wherein the at least one material of construction is selected from group consisting of pulp, paper, newsprint, cardboard, waxed cup stock non-waxed cup stock, natural fibers, synthetic fibers, bark, leaves and natural fibers.

13. The surface covering of claim 11 further including at least one chemical additive.

14. The surface covering of claim 11 wherein said varying thickness of said plurality of juxtaposed shaped articles is formed to provide an acoustic effect.

15. The wall surface covering of claim 11, wherein said shaped pulp articles are rectangular-shaped.

16. The wall surface covering of claim 11, wherein said varying thickness forms a pattern on said front surface of said shaped pulp articles.

17. The wall surface covering of claim 11, wherein said shaped pulp articles have a height axis parallel to said height, wherein said varying thickness forms a pattern on said front surface, said pattern being substantially symmetrical with respect to said height axis.

18. The wall surface covering of claim 17, wherein said shaped pulp articles have a width axis parallel to said width, wherein said varying thickness forms a pattern on said front surface, said pattern being substantially symmetrical with respect to said width axis.

19. The wall surface covering of claim 11, wherein said shaped pulp articles are sufficiently light in weight such that, where said adhesive is standard wallpaper paste, said shaped pulp articles can adhere to a standard wall surface.

20. The wall surface covering of claim 11, wherein said shaped pulp articles are formed to allow said shaped pulp articles to closely abut adjacent shaped pulp articles.

* * * * *